US006314930B1

(12) United States Patent
Eller et al.

(10) Patent No.: US 6,314,930 B1
(45) Date of Patent: Nov. 13, 2001

(54) TUBULAR HEATING OR MEASUREMENT DEVICE

(75) Inventors: Martin Eller; Martin Allgaier, both of Ludwigsburg (DE)

(73) Assignee: Beru AG, Ludwigsburg (DE)

( * ) Notice: Subject to any disclaimer, the term of this patent is extended or adjusted under 35 U.S.C. 154(b) by 0 days.

(21) Appl. No.: 09/421,230

(22) Filed: Oct. 20, 1999

(30) Foreign Application Priority Data

Oct. 23, 1998 (DE) ..... 198 49 120

(51) Int. Cl.[7] ..... F02B 9/08
(52) U.S. Cl. ..... 123/145; 219/270
(58) Field of Search ..... 123/145; 219/270

(56) References Cited

U.S. PATENT DOCUMENTS 6,062,185 * 5/2000 Chiu et al. ..... 123/145 A
6,064,039 * 5/2000 Kumada ..... 123/145 A
6,130,410 * 10/2000 Kita ..... 123/145 A
6,144,015 * 11/2000 Chiu et al. ..... 123/145 A
6,150,634 * 11/2000 Haussner et al. ..... 123/145 A

FOREIGN PATENT DOCUMENTS 0 887 592 12/1998 (EP) .

* cited by examiner

*Primary Examiner*—John Kwon
(74) *Attorney, Agent, or Firm*—Nixon Peabody LLP; David S. Safran

(57) ABSTRACT

A glow plug including a glow plug body formed from a single piece tube, the single piece tube including a plug tip area with a glow element disposed therein, a control area with a control element disposed therein, and a connection area with an inside connection lead adapted to be connected to an electrical terminal where the plug tip area has a different diameter than the control area and/or the connection area of the single piece tube.

16 Claims, 4 Drawing Sheets

TUBULAR HEATING OR MEASUREMENT DEVICE

BACKGROUND OF THE INVENTION

1. Field of the Invention

The invention relates to tubular or sleeve-shaped heating and measurement devices, especially glow plugs, heating plugs for preheating water, measurement and sensor elements.

2. Description of Related Art

It is desirable to produce glow plugs, heating plugs for preheating water, measurement and sensor elements to be as slender as possible for reasons of minimization of material consumption, the amount of space required, and weight. However, thermal stresses occur during the operation of the more slender and narrowly-dimensioned glow plugs known in the prior art lead to adverse effects on the function of these prior art glow plugs. In conventional glow plugs produced with an annular gap, vapor bubble formation and coking occurs in the annular gap thereby resulting in faulty measurements from a correspondingly built sensor.

Due to the reduction in the diameter of these devices though slenderizing together with the simultaneous demand for longer dimensioned rod glow plugs, major technical difficulties arise because of the required tolerances and the necessity of economical production of these devices. In particular, major technical problems in the manufacturing of such devices include adherence to concentricity tolerances, difficulties in sealing between the glow plug body and the glow tube and space problems in the area of the control spiral in rod glow plugs.

As an example, the prior art glow plug 100 as shown in FIG. 1 consists of the glow plug body 15, into which glow plug tip tube 16 is installed. The glow tube 16 includes a heating element 4 and a control element 5 that are embedded in an electrically insulating material for conducting heat, such as MgO. In the terminal-side area in the body 15, there is provided a connection lead 10. This area of the glow plug 100 is sealed by a seal 2 relative to the glow plug tip tube 16. The terminal-side area includes a cavity around the connection lead 10 which connects to an electric terminal 6. This cavity is sealed by another seal 3. This terminal-side of the glow plug body 15 has a thread 7 and a polyhedron 8. An annular gap 14 is provided proximate to the glow plug tip tube 16 in the combustion space-side exit area between the glow plug tip tube 16 and the glow plug body 15. As can be seen, the annular gap 14 is formed by increasing the diameter of the hole in the glow plug body 15. As can be readily appreciated, such prior art glow plugs are relatively complicated with many parts which are difficult to manufacture and assemble.

SUMMARY OF THE INVENTION

One object of the present invention is to overcome the limitation of prior art devices by enabling slenderizing of glow plugs, heating plugs for preheating water, measurement and sensor elements without adversely affecting their operation.

Another object of the present invention is to reduce deviations from concentricity of these devices.

Still another object of the present invention is to reduce the number of parts used in such glow plugs, heating plugs for preheating water, measurement and sensor elements.

These and other objects and advantages of the subject invention are obtained by a glow plug including a glow plug body formed from a single piece tube, the single piece tube including a plug tip area with a glow element disposed therein, a control area with a control element disposed therein, and a connection area with an inside connection lead adapted to be connected to an electrical terminal where the plug tip area has a different diameter than the control area and/or the connection area of the single piece tube.

These and other objects, features and advantages of the present invention will become more apparent from the following detailed description of the invention when viewed in conjunction with the accompanying drawings.

DETAILED DESCRIPTION OF THE PREFERRED EMBODIMENT

The present invention is described herein below together with the drawings as specifically applied to glow plugs. However, it should be noted that the present invention may also be readily applied to other tubular or sleeve-shaped heating and measurement devices, including heating plugs for preheating water, measurement and sensor elements. Therefore, the term Aglow plugs≃ is used in the general sense and should be construed to include tubular or sleeve-shaped heating and measurement devices including glow plugs, heating plugs for preheating water, measurement and sensor elements.

Figure 2:
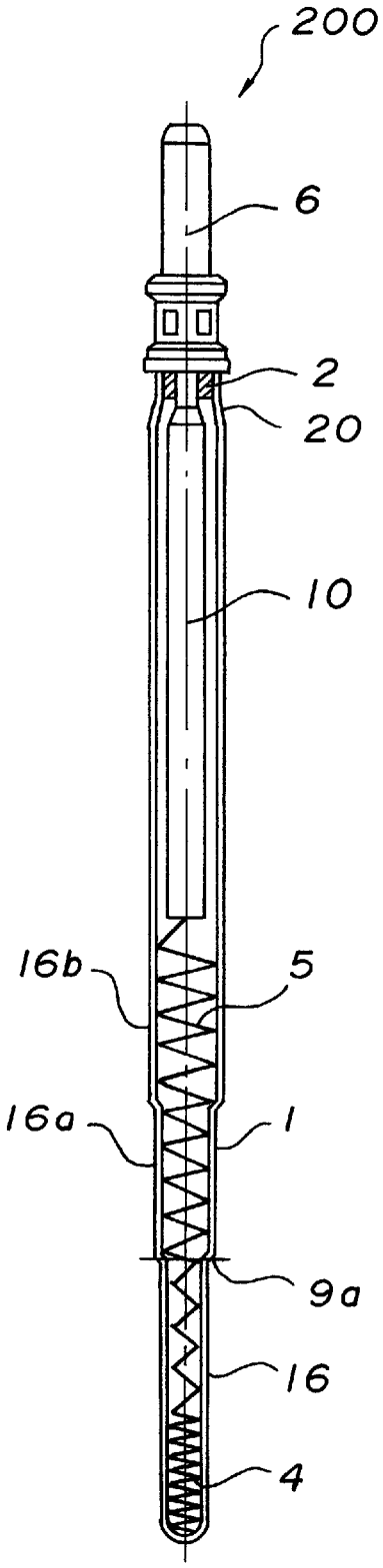
FIG. 2 is a partial cross-sectional view of a glow plug in accordance with one embodiment of the present invention.
Figure 1:
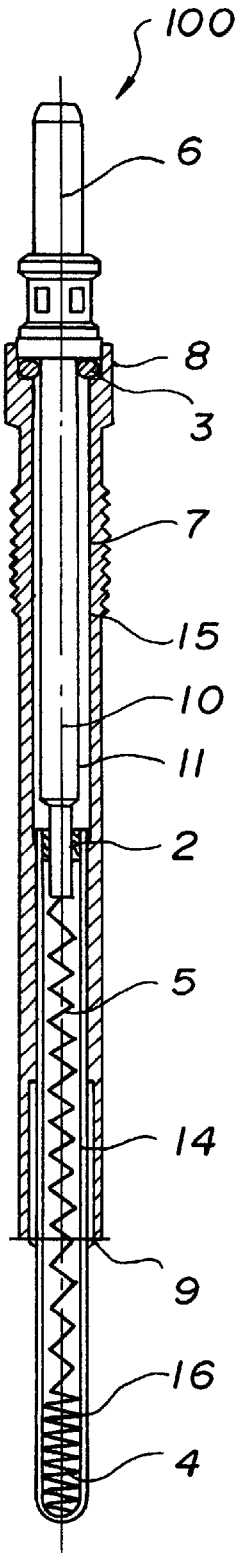
FIG. 1 (PRIOR ART)
FIG. 1 is a partial cross-sectional view of a prior art glow plug.

FIG. 2 shows a glow plug in accordance with one embodiment of the present invention including a single piece tube 1. Initially, it is noted that in reference to the present invention in FIGS. 2 to 7 as well as in the prior art glow plug of FIG. 1, common numerals have been used for similar components for ease of comparison.

As can be seen in FIG. 2, the diameter of the single piece tube 1 in the glow plug 200 in accordance with the present invention is reduced in a step like manner into tube sections of decreasing diameters. In the present illustrated embodiment, the plug tip area 16 of the single piece tube 1 has the smallest diameter and houses the heating element 4.

The tube section with the control area 16*a* adjacent to the plug tip area 16 in the terminal-side direction has a greater diameter than the plug tip area 16. The transition between the two tube sections is characterized by a peripheral sealing surface 9*a*. This sealing surface 9*a* is provided to interact with a corresponding seal seat surface 9*b* in a hole in the engine block (see FIG. 5) to provide sealing thereof. This tube section with the control area 16*a* may be provided a control element 5. Similarly, the tube section with the connection area 16*b* which adjoins the control area 16*a* in the terminal direction has a somewhat greater diameter than the control area 16*a* and houses a connecting lead 10 which is connected to or is made integral with the electrical terminal 6 through a seal 2 on the terminal-side end of the single piece tube 1. Preferably, the heating element 4, the control element 5 and the connection lead 10 are supported in a heat conducting, electrically nonconductive material, such as MgO.

Figure 3:
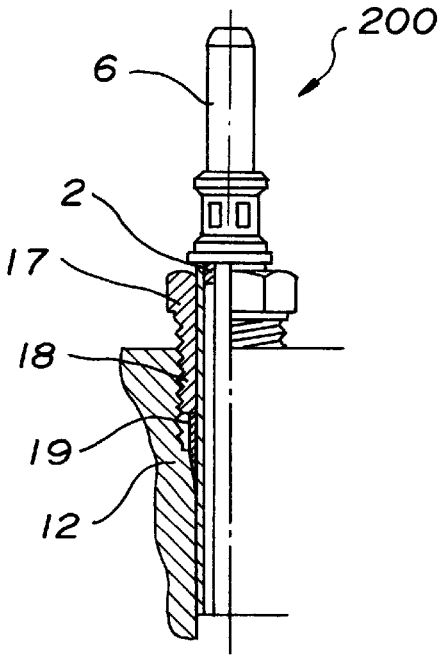
FIG. 3 is a partial cross-sectional view of the terminal-side area of a glow plug in accordance with the present invention with a union nut.

As shown in FIG. 3, the glow plug 200 in accordance with the present invention may be provided with a union nut 17 with an outside thread and optionally, an cutting ring 19 on the terminal-side end. The union nut 17 is used to fix the glow plug 200 into a hole in the engine block by screwing the union nut 17 into an inside thread 18 in the engine block 12. The cutting ring 19 seals the free space between the inside wall of the hole and the outside wall of the single piece tube 1 under the pressure of the tightened union nut 17.

Figure 4:
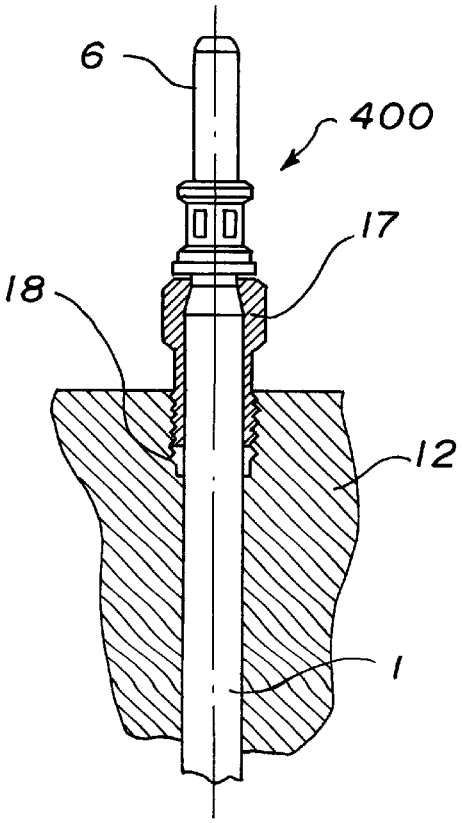
FIG. 4 is a partial cross-sectional view of the terminal-side area of a glow plug in accordance with another embodiment of the present invention with a union nut.

In FIG. 4, the glow plug 400 in accordance with the present invention does not have an annular ring. Rather, in an manner otherwise similar to FIG. 3 a seal is achieved by the contact of the sealing surface 9*a* on the single piece tube 1 as shown in FIG. 2 against a corresponding opposite seal seat surface in the hole of the engine block by tightening the union nut 17 into an inside thread 18 of the engine block 12.

Figure 5:
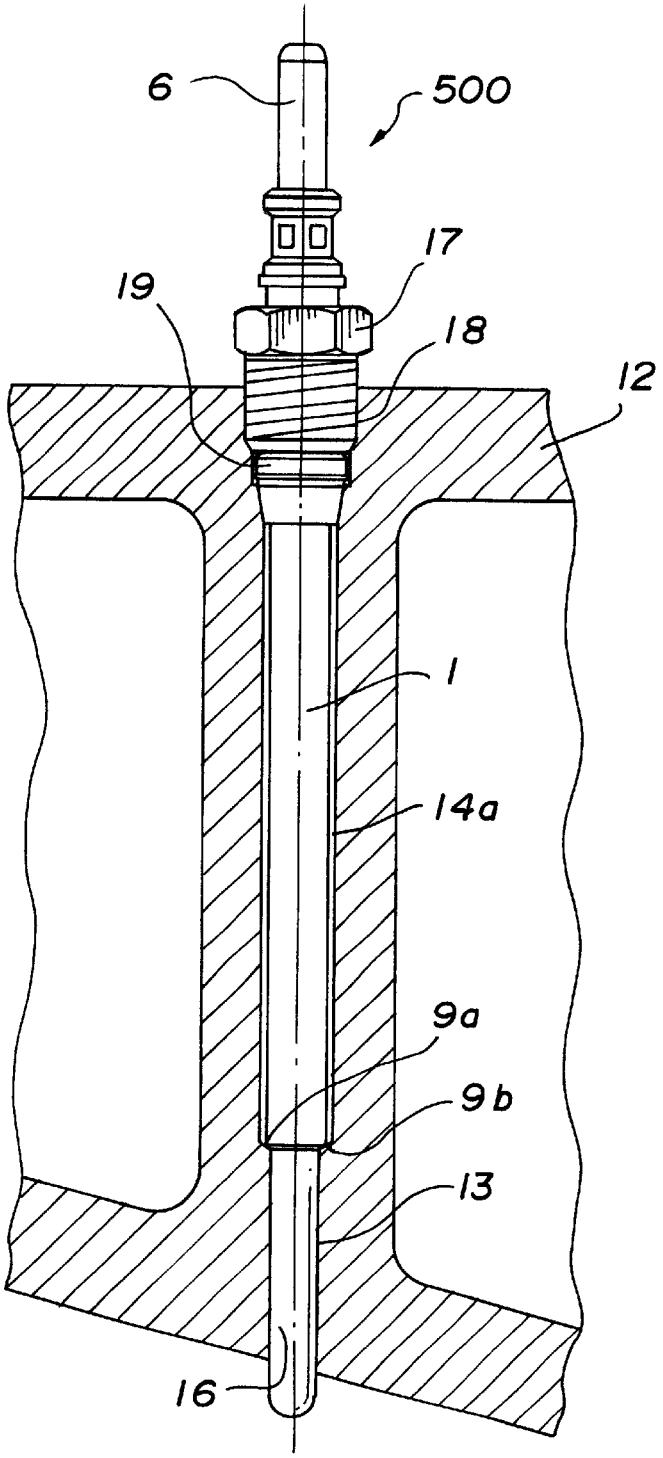
FIG. 5 is a side profile view of a glow plug in accordance with the present invention with a union nut and annular ring as installed in an engine block.

FIG. 5 shows another embodiment of a glow plug 500 in accordance with the present invention which can be fixed in a corresponding hole in the engine block 12 using a union nut 17 in a substantially similar manner as shown in FIG. 3, again, the common elements being enumerated with the same reference numerals. In this embodiment, the sealing surface 9*a* of the glow plug 500 interacts to form a seal with the corresponding opposite seal seat surface 9*b* in the hole in the engine block 12. Because the diameter of the plug tip area 16 of the single piece tube 1 is somewhat smaller than the corresponding areas of hole in the engine block 12, an air gap 13 is formed around the combustion space side of the single piece tube 1. In a similar manner, an annular gap 14*a* is formed between the remainder of the single piece tube 1 and the hole in the engine block 12. Moreover, the annular gap 14*a* is sealed relative to the air gap 13 by the sealing surface 9*a* and the corresponding opposite seal seat surface 9*b* in the hole.

Figure 7:
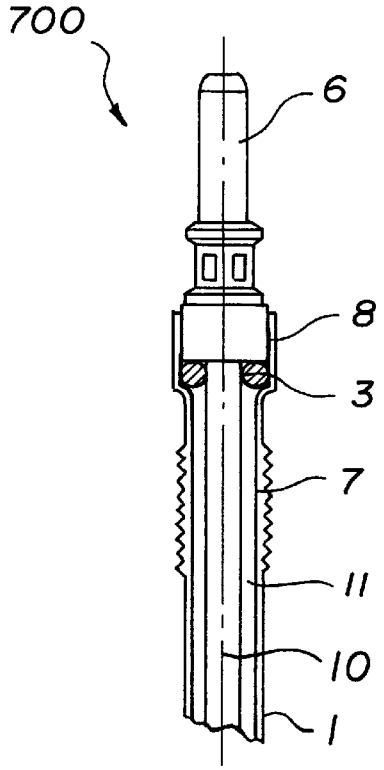
FIG. 7 is a partial cross-sectional view of the terminal-side area of a glow plug in accordance with another embodiment of the present invention including a rolled-on thread and a stamped-on polyhedron.
Figure 8:
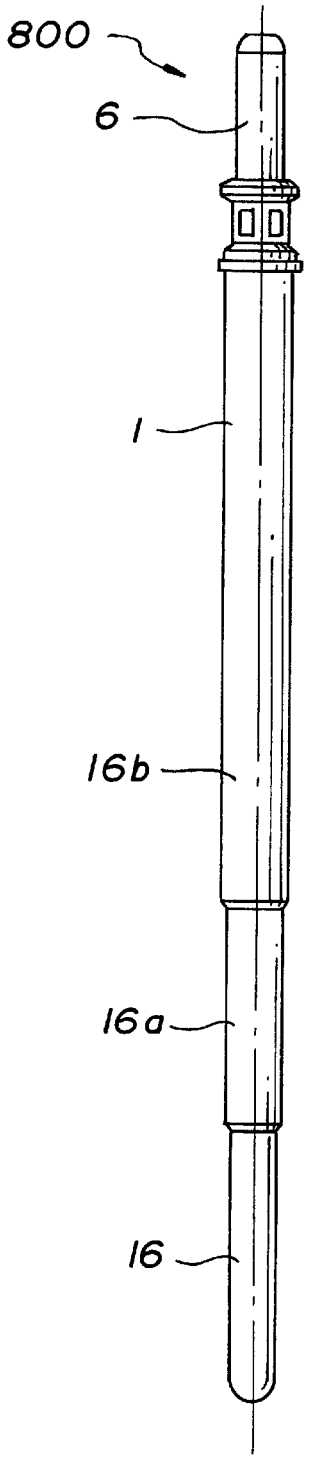
FIG. 8 shows yet another embodiment of a glow plug in accordance with the present invention but without the union nut.
Figure 6A:
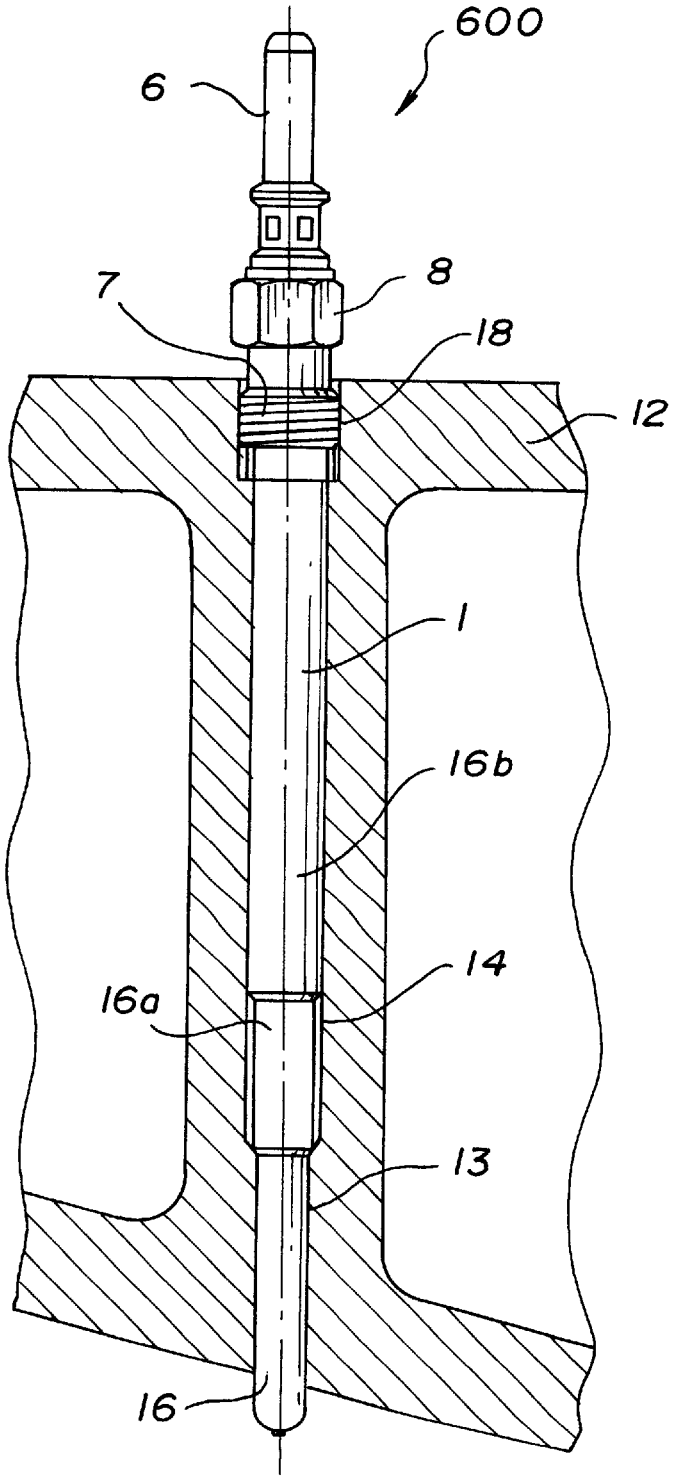
FIG. 6*a* is a side profile view of a glow plug in accordance with another embodiment of the present invention as installed in an engine block.
Figure 6B:
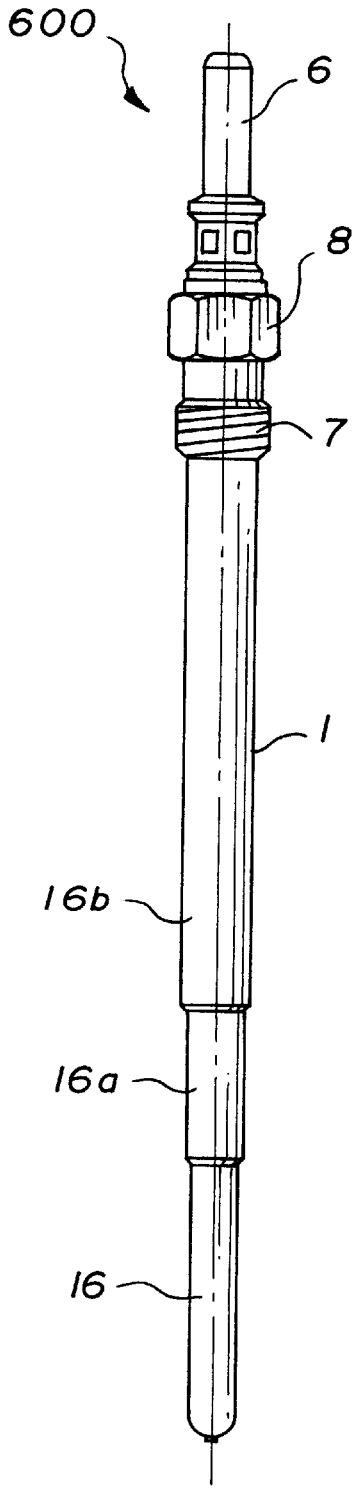
FIG. 6*b* is a side profile view of a glow plug of FIG. 6*a* removed from the engine block.

The embodiment of the glow plug 600 installed in the engine block 12 as shown in FIG. 6*a* corresponds essentially to the embodiment of FIG. 5 discussed above but with a rolled-on thread 7. The glow plus 600 in accordance with this embodiment is more clearly shown in FIG. 6*b*. In addition, the embodiment of the glow plug 700 as shown in FIG. 7 also corresponds essentially with the embodiment of FIGS. 5, 6*a* and 6*b* but with a stamped-on polyhedron 8 which is integral with the single piece tube 1. FIG. 8 shows yet another embodiment of a glow plug 800 in accordance with the present invention but without the union nut. Again, the common components in these various figures have been enumerated using the same numerals but the discussions of these common components have been omitted to avoid repetition.

While various embodiments in accordance with the present invention have been shown and described, it is understood that the invention is not limited thereto. These embodiments may be changed, modified and further applied by those skilled in the art. Therefore, this invention is not limited to the details shown and described previously but also includes all such changes and modifications which are encompassed by the appended claims

We claim:

1. Glow plug comprising:

a glow plug body formed from a single piece tube, said single piece tube including a plug tip area with a glow element disposed therein, a control area with a control element disposed therein, and a connection area with an inside connection lead adapted to be connected to an electrical terminal;

wherein said plug tip area has a different diameter than at least one of said control area and said connection area of said single piece tube.

2. Glow plug of claim 1, further comprising a sealing surface formed by a transition between said plug tip area and at least one of said control area and said connection area of said single piece tube having a different diameter than said plug tip area.

3. Glow plug of claim 1, further comprising a seal disposed within said single piece tube proximate to said electrical terminal for sealing an interior of said single piece tube from exterior of said single piece tube while allowing said inside connection lead to be connected to said electrical terminal.

4. Glow plug of claim 3, wherein said single piece tube is filled with heat-conductive, electrically nonconductive material so that said heating element, said control element and said connection lead are embedded therein.

5. Glow plug of claim 1, wherein said single piece tube includes threads and a stamped-on polyhedron proximate to said electrical terminal.

6. Glow plug of claim 1, further comprising a union nut proximate to said electrical terminal for installing said glow plug in a threaded hole.

7. Glow plug of claim 6, further comprising an annular ring for sealing a space between an inside wall of said threaded hole and an outside wall of said single piece tube.

8. Glow plug of claim 2, said glow plug being adapted to be installed in a threaded hole which extends into a combustion space-side area of an engine block and which has a larger diameter than a diameter of said plug tip area of said single piece tube for forming an air gap therebetween, said single piece tube being adapted for sealing against a seal seat surface of said threaded hole, and said control area of said single piece tube being adapted to form an annular gap with respect to an area of said threaded hole.

9. Glow plug of claim 8, further comprising a union nut proximate to said electrical terminal for installing said glow plug in said threaded hole and to seat said sealing surface of said single piece tube against said seal seat surface of said threaded hole.

10. Glow plug of claim 9, further comprising an cutting ring for sealing said annular gap between said threaded hole and said control area of said single piece tube.

11. Glow plug of claim 8, wherein said single piece tube includes threads and a stamped-on polyhedron proximate to said electrical terminal.

12. A combustion arrangement comprising a combustion space-side area of an engine block with a threaded hole which extends therein and a glow plug, said glow plug having a glow plug body formed from a single piece tube, said single piece tube including a control area with a control element disposed therein, a connection area with an inside connection lead adapted to be connected to an electrical terminal, a plug tip area with a glow element disposed therein, said plug tip area having a different diameter than at least one of said control area and said connection area of said single piece tube, and a sealing surface formed by a transition between said plug tip area and at least one of said control area and said connection area of said single piece tube having a different diameter than said plug tip area; wherein said glow plug is installed in said threaded hole; wherein said hole has a larger diameter than a diameter of said plug tip area of said single piece tube thereby forming an air gap therein between; wherein said threaded hole also has a seal seat surface which seals against said sealing surface of said single piece tube; and wherein an area of said threaded hole corresponding to said control area of said single piece tube has a diameter larger than a diameter of said control area thereby forming an annular gap therebetween.

13. Combustion arrangement of claim 12, further comprising a union nut proximate to said electrical terminal, said union nut holding said glow plug in said threaded hole and seating said sealing surface of said single piece tube against said seal seat surface of said threaded hole.

14. Glow plug of claim 13, further comprising an annular ring sealing said annular gap.

15. Glow plug of claim 12, wherein said single piece tube includes threads and a stamped-on polyhedron proximate to said electrical terminal.

16. Glow plug comprising:

a glow plug body formed from a single piece tube, said single piece tube including a plug tip area with a glow element disposed therein, a control area with a control element disposed therein, and a connection area with an inside connection lead adapted to be connected to an electrical terminal;

wherein each of said plug tip area, control area, and connection area has a different diameter from each other.

* * * * *